US006182791B1

(12) United States Patent
Cope

(10) Patent No.: US 6,182,791 B1
(45) Date of Patent: Feb. 6, 2001

(54) ADJUSTABLE SCAFFOLDING AND LIFT CARRIAGE AND SUPPORT MEMBER THEREFOR

(76) Inventor: James L. Cope, P.O. Box 160, Yankton, SD (US) 57078

( * ) Notice: Under 35 U.S.C. 154(b), the term of this patent shall be extended for 0 days.

(21) Appl. No.: 09/099,848

(22) Filed: Jun. 19, 1998

(51) Int. Cl.[7] ..... B66B 9/00
(52) U.S. Cl. ..... 182/141; 182/146
(58) Field of Search ..... 182/141, 146; 187/270, 268, 255, 213, 214

(56) References Cited

U.S. PATENT DOCUMENTS

| | | | | |
|---|---|---|---|---|
| 797,077 | | 8/1905 | Shaw . | |
| 813,830 | | 2/1906 | Robidoux . | |
| 1,442,075 | | 1/1923 | Knechtel . | |
| 1,927,598 | | 9/1933 | Schlichter . | |
| 2,007,480 | | 7/1935 | Schernekau . | |
| 3,018,842 | | 1/1962 | Abrell . | |
| 3,071,205 | | 1/1963 | Beck . | |
| 3,318,414 | * | 5/1967 | Meek | 182/146 |
| 3,610,368 | | 10/1971 | Johnson . | |
| 3,851,728 | | 12/1974 | Williams . | |
| 3,937,301 | * | 2/1976 | Bertail | 187/270 |
| 3,946,836 | | 3/1976 | Maack . | |
| 4,534,446 | | 8/1985 | Pujol-Barcons . | |
| 4,942,940 | | 7/1990 | Boeshart . | |
| 5,487,446 | | 1/1996 | Patnode et al. . | |

FOREIGN PATENT DOCUMENTS

| | | | | |
|---|---|---|---|---|
| 923828 | * | 4/1973 | (CA) | 182/141 |
| 2617771 | * | 4/1976 | (DE) | 182/133 |
| 3939762 | * | 6/1991 | (DE) | 182/270 |
| 41628 | * | 12/1981 | (EP) | 182/141 |
| 150011 | | 9/1920 | (GB) . | |
| 630.183 | * | 10/1978 | (SU) | 182/270 |

* cited by examiner

*Primary Examiner*—Alvin Chin-Shue
(74) *Attorney, Agent, or Firm*—Dorsey & Whitney LLP

(57) ABSTRACT

A lift apparatus having a pair of support members and a carriage movable along the support members. The carriage includes a pair of rotating members, a band extending between and around the rotating members and a plurality of lift members carried by the band and engageable with support surfaces on the support members. The invention also relates to a support member and a carriage useable with the lift apparatus.

19 Claims, 7 Drawing Sheets

D1
D2
16
28
29
30
44
45
55
56
57
59
65

ADJUSTABLE SCAFFOLDING AND LIFT CARRIAGE AND SUPPORT MEMBER THEREFOR

BACKGROUND OF THE INVENTION

1. Field of the Invention

The present application relates generally to an adjustable support apparatus including an adjustable lift carriage and support member, and more particularly to an adjustable scaffolding structure including an adjustable lift carriage and platform support and a support tower for use therewith.

2. Description of the Prior Art

Various types of adjustable scaffolding exist in the art. Such adjustable scaffolding commonly is used in the construction industry for supporting construction workers and/or materials during the construction, maintenance or demolition of a structure. A common scaffolding structure currently existing in the art includes a cable and winch assembly for raising and lowering a carriage and associated platform support along a plurality of generally vertical tower supports. Although the cable and winch systems have performed generally satisfactorily, cables require a great deal of care and maintenance to maintain their strength. The failure to properly care and maintain cables and the winch assembly in such a system has resulted in system failure and personal injury.

Various types of adjustable scaffolding and lift systems exist in the art. These function primarily to support worker and/or material platforms for use during construction, repair, maintenance or demolition of a structure. Examples include non-cable systems such as those described in the Maack U.S. Pat. No. 3,946,836. Maack discloses the use of a rotatable endless belt with a plurality of regularly spaced openings that sequentially engage lugs protruding from a vertical structure. The belt is supported by two vertically spaced sprockets in which one or more teeth are purposely deleted so that the sprocket teeth do not make contact with the lugs while the sprockets are rotating. A requirement of the Maack disclosure is that the spacing of the lugs must be an integral multiple of the spacing between the belt openings.

The Pujol U.S. Pat. No. 4,534,446, the Patnode U.S. Pat. No. 5,487,446, the Schernekau U.S. Pat. No. 2,007,480, the Knechtel U.S. Pat. No. 1,442,075, the Beck U.S. Pat. No. 3,071,205 and the Allen UK Patent No. 150,011 also disclose non-cable means for moving a platform up and down a vertical structure. The Pujol patent discloses the use of a wheel with radial projections that sequentially engage perforations in the vertical structure and in which the wheels are rotated by a rotatable worm drive and crown gear assembly. The Patnode patent discloses the use of a sprocket with peripheral teeth that sequentially engage apertures in the vertical structure in order to move the attached platform up and down the structure. In Patnode, with the sprocket is rotated by means of a bevel gear assembly. The Schernekeau and Knechtel patents disclose the use of two sets of staggered radial pins which sequentially engage perforations in their respective vertical structures. The Beck and Allen patents disclose using conventional rack and pinion means.

One of the most commonly used adjustable scaffolding systems involves the use of a winch and cable for raising and lowering a support platform relative to a pair of support towers. In these systems one end of the cable is hooked to the top or an upper portion of the tower and the other end is wound onto a winch which is mounted to the carriage. Rotation of the winch causes the carriage and its related structure to be pulled up the tower by the cable. While winch and cable systems function generally satisfactorily, such systems have several limitations. First, cables require a great deal of care and maintenance to maintain their strength. Second, the lift capacity of a winch and cable system is related directly to the size and strength of the cable. For most applications this has practical limitations. Third, use of winch and cable systems is labor intensive in that it requires extensive time for handling and maintaining the cable and dealing with broken, rusted, frayed or otherwise damaged cable. Fourth, when utilizing cable and winch systems, it is necessary to align and re-hook the cable as additional tower sections are added or removed.

Accordingly, there is a need in the art for a lift system, and particularly an adjustable scaffolding system, which improves lift capacity, minimizes care and maintenance, and totally eliminates the cable and winch and the various limitations thereof.

SUMMARY OF THE INVENTION

In accordance with the present invention, an improved cableless lift system or adjustable scaffolding system is provided. Such system eliminates the cable and winch and provides a structure which increases the lift capacity of the lift carriage and significantly reduces, care, maintenance, handling and other time consuming tasks commonly associated with cable and winch systems.

The present invention includes an improved carriage assembly which is designed to move up and down a vertical support member without the use of cable and winch elements. The preferred embodiment of the lift system of the present invention further includes a plurality of support members with a series of spaced first support surfaces positioned along the longitudinal axis of the support members. The improved carriage assembly includes a pair of rotatable members with an endless band such as a chain, belt or the like extending between and around the rotatable members. The band carries a plurality of spaced lift members each having a second support surface for engagement with the first support surfaces of the support member as the rotatable members are rotated. In the preferred embodiment, the spacing between adjacent first support surfaces on the support member is greater than the spacing between the second support surfaces of adjacent lift members.

Because of this spacing difference, the lift carriage and its associated platform and platform supports are supported primarily by engagement between one first support surface and one second support surface at any one time. This spacing relationship also enables the second support surface of the non-engaged lift members to clear the first support surface during their movement around and between the rotatable members. In the preferred embodiment, the rotatable members comprise a pair of spaced toothed sprockets carrying an endless roller chain and being rotatably supported within an elongated support housing. The support housing includes a wall portion functioning as a band or chain support to ensure engagement between the first and second support surfaces during operation of the system. The preferred embodiment of the carriage assembly is also provided with a ratchet dog, a speed regulating dog and a safety catch to prevent the carriage from falling in the event of a lift system failure. A plurality of platform supports similar to those which are common in the art are also provided.

The vertical support or tower members in accordance with the present invention comprise at least a pair of generally parallel, support posts with a plurality of support braces functioning both to interconnect and brace the support posts and to provide the plurality of spaced first support surfaces. The support members may be comprised of single elongated structures or of a plurality of support member sections connected to one another in end to end relationship. In both embodiments, consistent longitudinal spacing of the support braces, and thus the first support surfaces, is maintained throughout the entire support member length.

Accordingly it is an object of the present invention to provide an improved cableless adjustable scaffolding or lift system.

Another object of the present invention is to provide an adjustable scaffolding or lift system with improved lift capacity.

Another object of the present invention is provide an adjustable scaffolding lift carriage which is free of the conventional cable and winch members and which eliminates limitations of such cable and winch systems.

A still further object of the present invention is to provide an improved support or tower member for use with the above described lift system.

A still further object of the present invention is to provide an improved adjustable scaffolding assembly comprising an improved cableless lift carriage, a plurality of tower supports and a supporting platform.

These and other objects of the present invention will become apparent with reference to the drawings, the description of the preferred embodiment and the appended claims.

DESCRIPTION OF THE PREFERRED EMBODIMENT

The present invention relates generally to a lift assembly of the type having one or more elongated support frame members and a lift carriage moveable along each frame member. The preferred embodiment of the present invention is described with reference to what is commonly referred to as adjustable scaffolding comprising two or more vertically positioned support towers and a lift carriage moveable up and down along the support towers. Unless otherwise specifically limited, it is intended that the scope and benefits of the present invention are applicable not only to an adjustable scaffolding application, but to any other lift apparatus or assembly as well.

Further, the description of the preferred embodiment discloses details of the entire lift assembly as well as details of the improved lift carriage and the support tower or support frame, both individually as well as in combination. It is intended that the improved lift carriage in accordance with the present invention may be usable with support towers other than those specifically described in the present application and that similarly, the support tower or frame members will be useful with lift carriages other than those specifically described herein.

Figure 1:
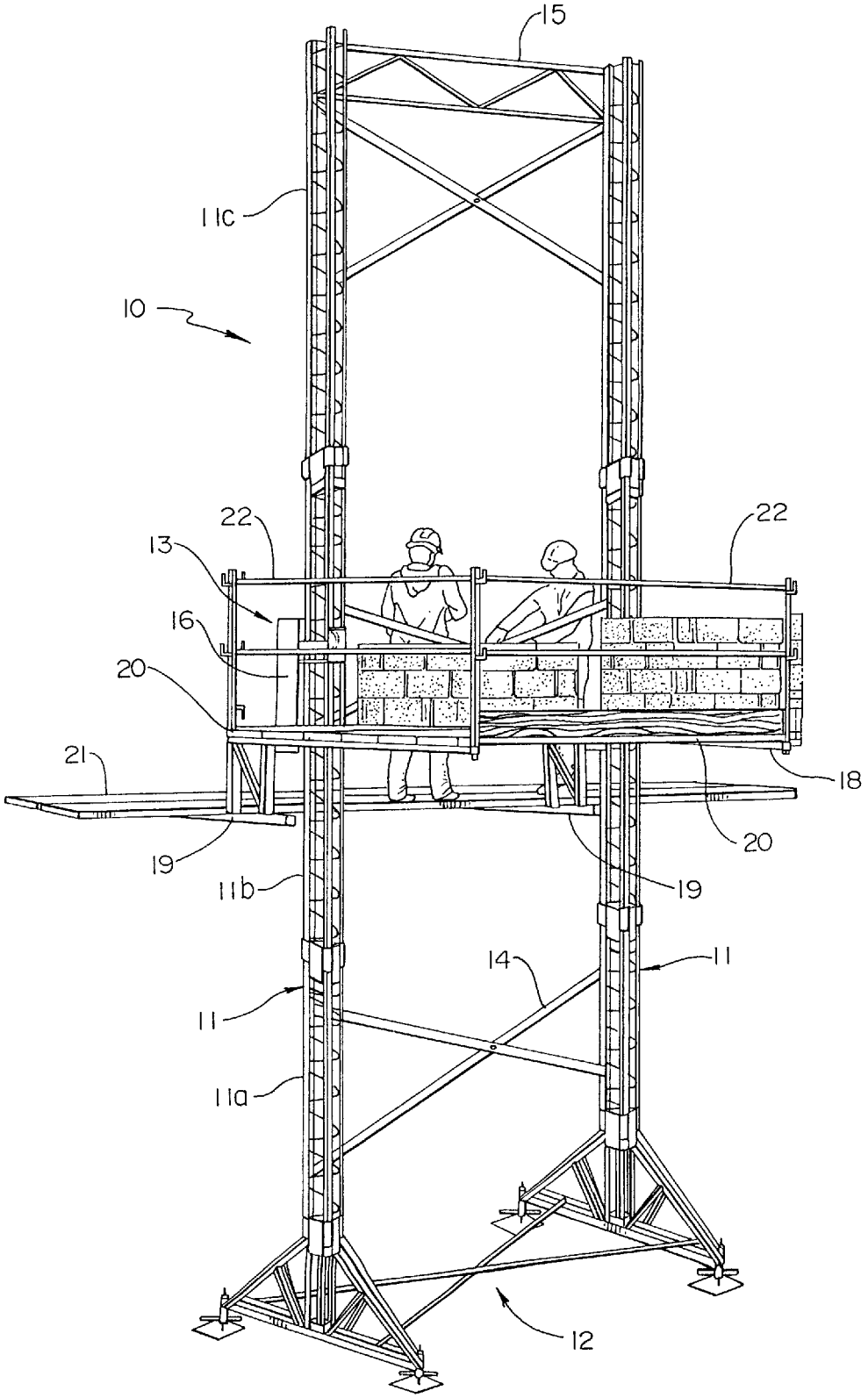
FIG. 1 is an isometric view of an adjustable scaffolding assembly in accordance with the present invention.

With reference first to FIG. 1, the lift assembly of the present invention is shown in the form of an adjustable scaffolding assembly 10. The adjustable scaffolding assembly 10 includes a pair of support towers or support members 11. Where shorter scaffolding is needed, these members 11 can be of a single length. For taller scaffolding, however, as shown in the preferred embodiment, the members 11 are comprised of a plurality support tower or support member sections 11*a*, 11*b* and 11*c*. These sections 11*a*, 11*b*, and 11*c* are connected in end to end relationship with one another to form the elongated support tower 11 with a longitudinal axis. The pair of support towers 11 are supported at their bottom ends by a base 12 in a manner well known in the art and are stabilized throughout their length and at their free end by a plurality of cross braces 14 and/or a panel brace 15. It is also common for multiple support towers or pairs of support towers to be interconnected with one another by cross braces or stringer braces as known in the art to span greater distances.

A carriage assembly 13 is associated with each of the support towers 11. Each carriage assembly includes a material or material/laborer platform bracket 18 and a workman platform bracket 19. As shown, a major portion of the material platform bracket 18 extends outwardly from the side of the support towers 11 opposite the building structure, while a major portion of the workman support bracket 19 extends outwardly from the support tower 11 adjacent to the building structure. A plurality of planks are extended between adjacent material platform brackets 18 to provide a material or material/laborer platform 20. Similarly, a plurality of planks are provided between the workman support brackets 19 to provide a workman platform 21. A plurality of guard rails or railing sections 22 are connected with the material platform brackets 18. It should be noted that the structural details relating to the base 12, the material and workman platform brackets 18 and 19, the planks and their platforms 20 and 21, and the guard rails 22 are well known to those skilled in the art.

Each carriage assembly 13 further includes a lift carriage 16 associated with one of the frame members 11. Each of the carriages 16 is connected with the platform brackets 18 and 19 as described below and includes raising and lowering means to facilitate the selective raising and lowering of the brackets 18 and 19, and thus the material and workman platforms 20 and 21, along the support members 11.

Figure 2:
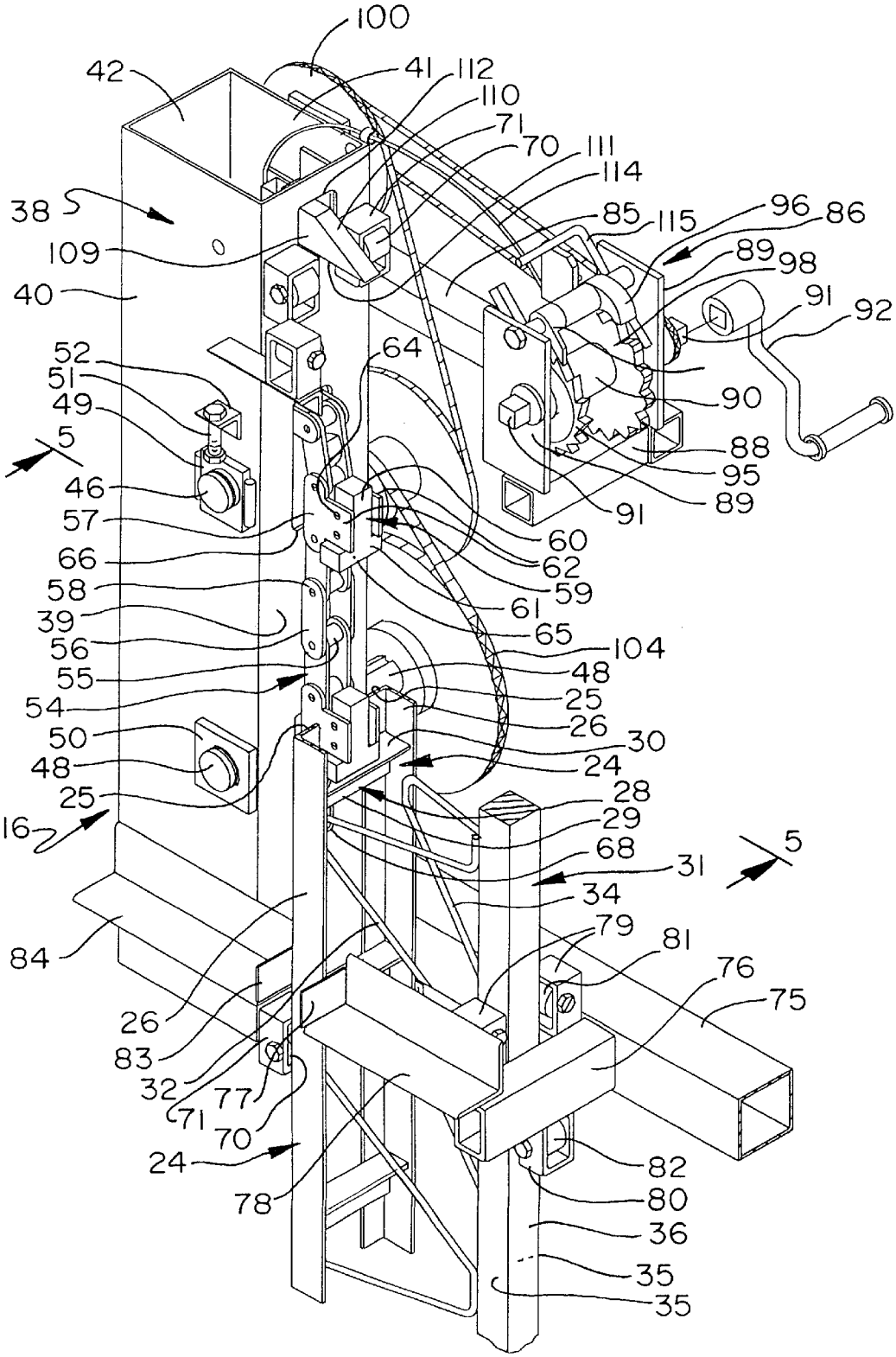
FIG. 2 is an isometric view of the lift carriage assembly in accordance with the present invention and its relationship to a portion of the support tower.
Figure 3:
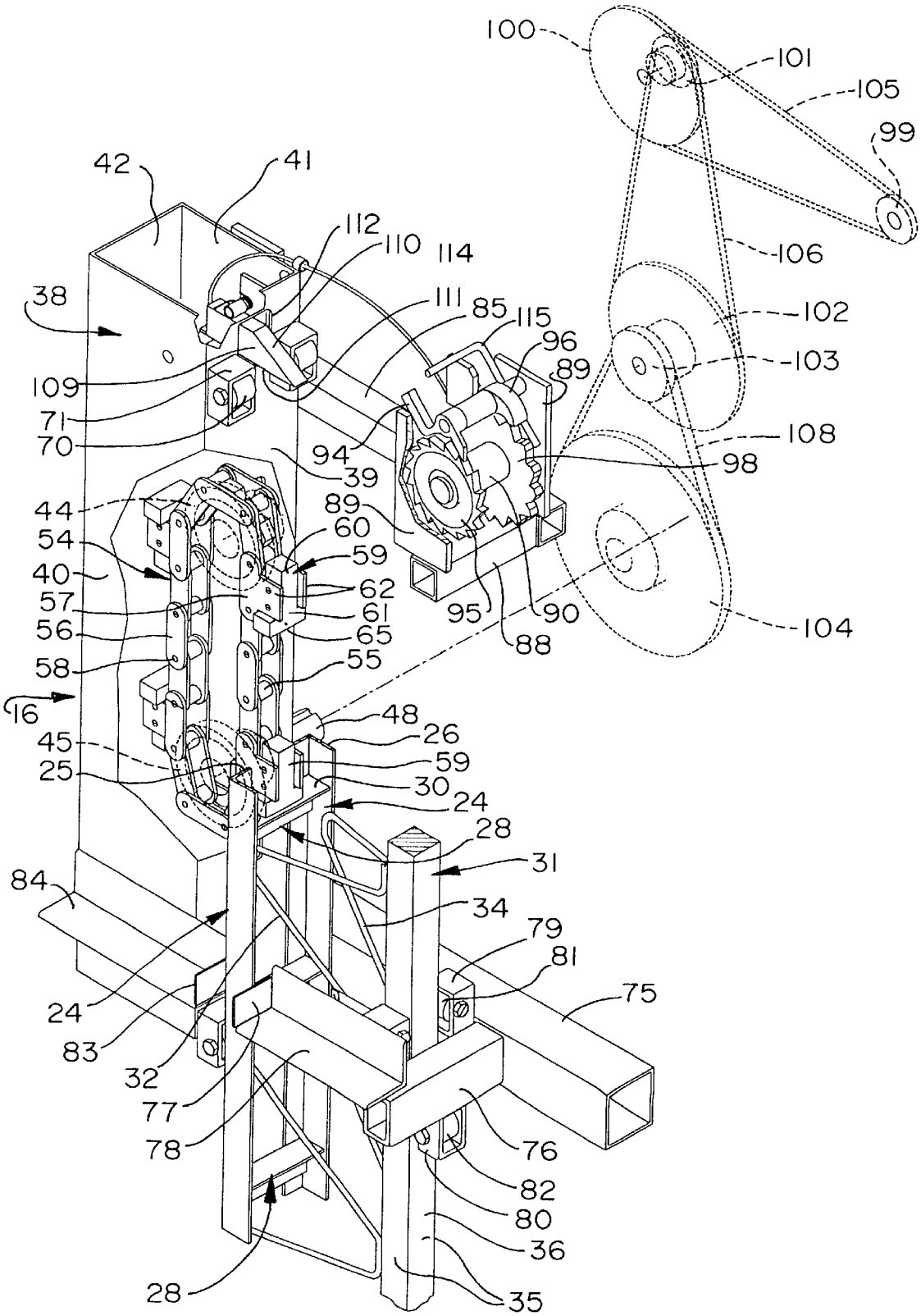
FIG. 3 is a further isometric view of the lift carriage assembly of the present invention similar to FIG. 2 with portions broken away and showing the carriage drive mechanism separated from the carriage housing.

Reference is next made to FIGS. 2 and 3 illustrating enlarged isometric views of the carriage 16 and a portion of the support tower 11, with portions broken away. As shown, the support tower 11 includes a pair of laterally spaced support posts 24,24. These posts 24,24, when the carriage assembly is erected, extend vertically in a direction generally parallel to one another and to the longitudinal axis of the support tower 11 and define a support post plane. In the preferred embodiment, the support posts 24,24 are formed from rigid angle members having a pair of outer faces 25 and 26 positioned at right angles to one another. As shown in FIGS. 2 and 3, as well as in FIG. 5, the side surfaces 26,26 of the support posts 24,24 are laterally spaced and generally parallel to one another, while the surfaces 25,25 are laterally spaced from one another and lie substantially in a common plane. A plurality of laterally extending brace members 28 are rigidly secured to the support posts 24 by welding or the like. The brace members 28 are spaced vertically along the entire length of the support posts 24,24. As will be discussed in greater detail below, the spacing of these brace members 28 throughout the entire length of the support towers 11 is constant whether the tower 11 is a single length or is comprised of sections 11*a*, 11*b*, 11*c*. The brace members 28 can have a variety of configurations; however, in the preferred embodiment, the brace members 28 comprise an angle member welded to the inner surfaces of the support posts 24 opposite the outer faces 25 and 26. As shown, one leg 29 of the member 28 is welded to an inside surface of the posts 24 opposite the face 25 and the other leg extends generally laterally and at right angles to the longitudinal axis of the support tower 11 to form a first support surface 30.

Each support tower 11 is also provided with a third support post 31 extending the entire length of the support tower 11. When the support tower 11 is comprised of a plurality of support tower sections 11*a*, 11*b* and 11*c* (FIG. 1), the first and second support posts 24,24 and the third support post 31 comprise support post sections extending the entire length of the sections 11*a*, 11*b* and 11*c*. Brace members 32 and 34 are provided between the support posts 24,24 and 31 as shown to provide proper spacing between such support posts and to ensure rigidity of the entire support tower 11. In the preferred embodiment, the brace members 32 and 34 are elongated, bent brace members which are welded to inner facing surfaces of the support posts 24,24 and 31. In the preferred embodiment, the cross sectional configuration of the support post 31 is square to provide a pair of generally planar side roller guide surfaces 35,35 generally perpendicular to the support post plane and a rear roller guide surface 36 generally parallel to the support post plane. The outer surfaces 25 and 26 of the posts 24,24 are also generally planar to provide roller guide surfaces as discussed in greater detail below. FIGS. 2 and 3 show the tower 11 with the top portions of the posts 24,24 and the post 31 broken away for clarity. In actuality, these posts 24,24 and 31 extend to the top of the tower 11 as shown in FIG. 1. Although the preferred embodiment shows the support post 31 as square, it could also be angled, with rollers engaging the two angled surfaces. Further, although the preferred embodiment discloses the support tower 11 as comprising first, second and third support posts, any number can be used. For example, a support tower with two support posts or with four or more support posts is possible as long as the structure includes the spaced first support surfaces 30 as described.

With continuing reference to FIGS. 2 and 3, the carriage 16 includes an elongated generally tubular rigid housing 38 having back and front walls 39 and 42, respectively and a pair of side walls 40 and 41. Although the preferred embodiment shows the tubular carriage housing of the preferred embodiment to be a four sided housing with a generally rectangular cross section, it is intended that the term "tubular housing" as used in describing the housing 38 of the present invention could also be a three sided housing comprised of the wall 39 and the side walls 40 and 41.

As shown best in FIGS. 2 and 3, a pair of rotatable members 44 and 45 are rotatably supported on shafts 46 and 48, respectively, between the side walls 40 and 41 of the carriage housing 38. The shafts 46 and 48 are supported by suitable bearings within bearing blocks/housings 49 and 50 in a manner known in the art. The vertical position of the shaft 46, and thus the rotatable member 44, is adjustable via a threaded adjustment member 51. As shown, the adjustment member 51 is associated with an adjustment bracket 52 connected with each of the side walls 40 and 41. Vertical adjustment of the rotatable member 44 facilitates corresponding adjustment of the endless band 54 extending between the members 44 and 45.

As shown, the endless band 54 extends around and between the pair of rotatable members 44 and 45 so that rotation of the members 44 and 45 causes corresponding movement of the band 54. It is intended that the benefits of the present invention can be realized regardless of the type of endless band or rotatable members that are utilized. For example, the endless band 54 could be a chain, a belt or some other endless member and the rotatable members 44 and 45 could be a toothed sprocket, a pulley or some other rotatable member cooperating with the band member either by friction or positive engagement. Thus, unless otherwise specifically stated, the terms "band" and "rotatable member" as used in describing the present invention is intended to cover not only a roller chain for use with a toothed sprocket as described in the preferred embodiment, but a belt and pulley as well as any other endless member and corresponding rotating member.

In the preferred embodiment, the rotatable members 44 and 45 are toothed sprockets and the endless band member 54 is a roller chain. The roller chain 54 includes a plurality of rollers 55 and connecting links 56 and lift member support links 57. As known in the art, the rollers 55 are connected with the links 56 and 57 by pins 58. The size and load rating of the chain should be selected to provide sufficient capacity in its use for the adjustable scaffolding applications of the preferred embodiment. Preferably the roller chain size should be at least #80. Positioned along the endless chain 54 in equally spaced relationship and connected with the support links 57 are a plurality of lift members 59. In the preferred embodiment, each of the lift members 59 includes a narrow section 60 and a wide section 61. The narrow section 60 is rigidly secured between spaced attachment ears 62,62 of the links 57. In the preferred embodiment, the narrow portion 60 is rigidly secured to the attachment ears 62,62 by a pair of threaded members or rivets 64. The wide section 61 includes a bottom surface defining a bottom second support surface 65 for engagement with the first support surface 30. In the preferred embodiment, the distance between the lift members 57 along the chain 54, and thus the distance between adjacent second support surfaces 65, is constant. As shown and described in greater detail below, the distance between adjacent second support surfaces 65 must be less than the distance between adjacent first support surfaces 30. Further, because the distance between adjacent lift members 57 must be the same, the length of the chain 54 must be integral multiples of that distance.

As shown, the attachment ears 62,62 of the support links 57 are positioned on opposite sides of the lift member 59 and support the lift member 59, and thus the second support surface 65, outwardly of the chain 54 and the rollers 55. As understood best with reference to FIG. 3, the chain 54, and thus the lift members 59, travel around and between the sprockets 44 and 55 as the sprockets 44 and 45 rotate.

Figure 5:
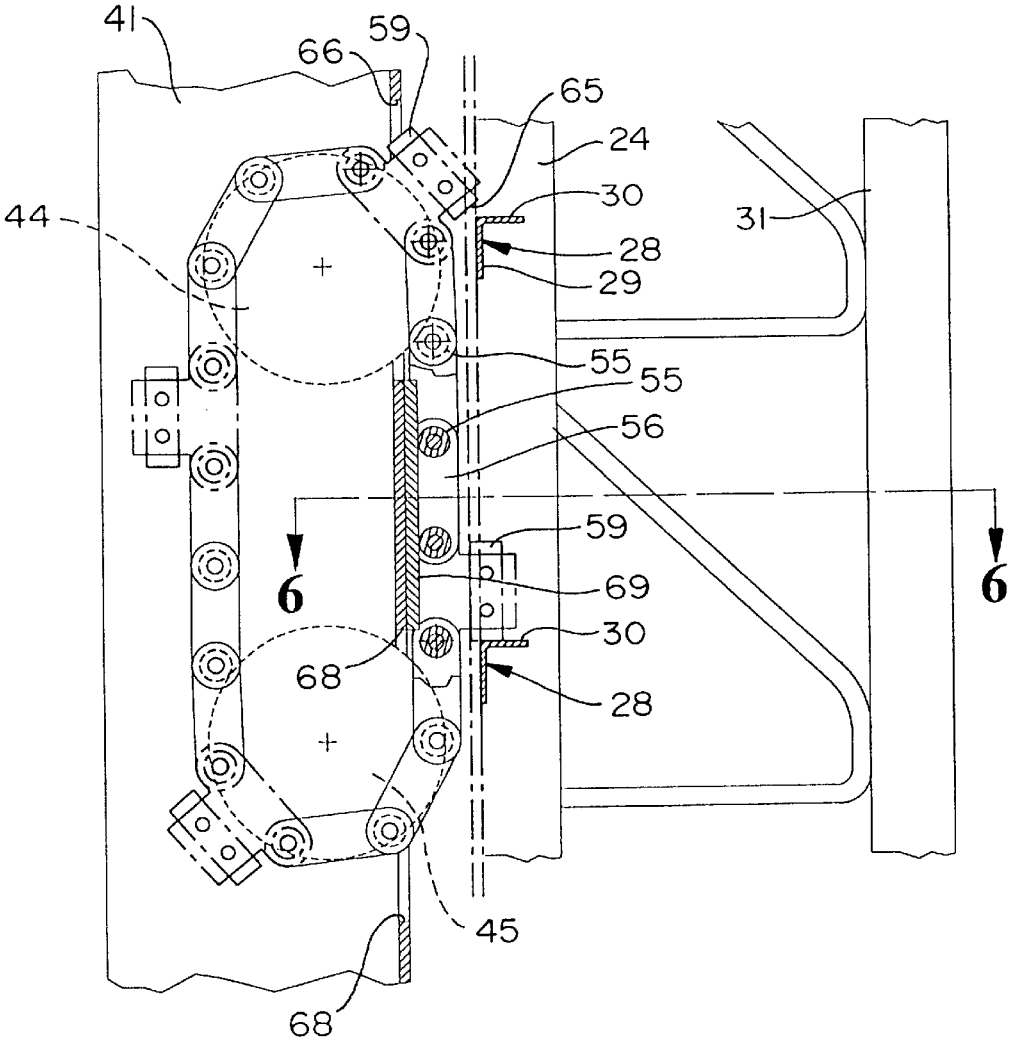
FIG. 5 is a view, partially in section, as viewed along the section line 5—5 of FIG. 2.
Figure 6:
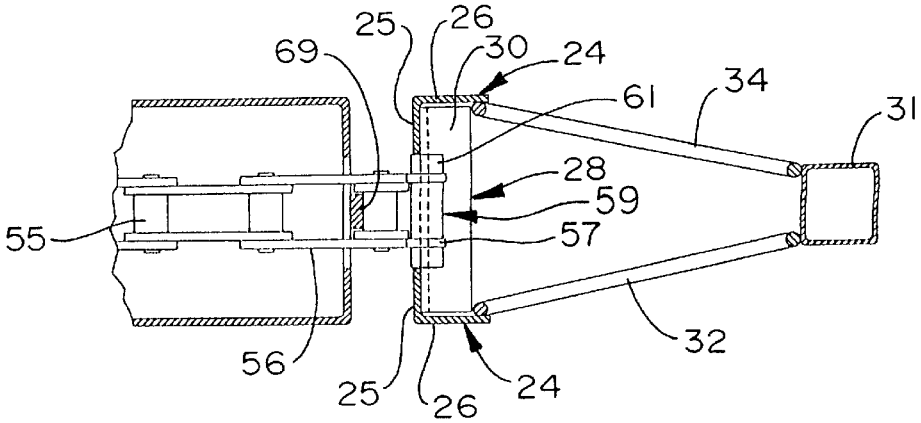
FIG. 6 is a view, partially in section, as viewed along the section line 6—6 of FIG. 5 showing a portion of the lift carriage assembly and the relationship between the roller chain, the carriage support housing and the lift members.

With continuing reference to FIGS. 2 and 3, and more specific reference to FIGS. 5 and 6, the sprockets 44 and 45 are mounted between the side walls 40 and 41 in a position such that a portion of the sprockets and a portion of the chain 54 that extends between the sprockets 44 and 45 are outside of, or on the tower side of, the wall 39 of the tubular housing 38. To accommodate this, the wall 39 is provided with upper and lower band or chain access openings 66 and 68, respectively. Thus, the sprockets 44 and 45 are mounted between the walls 40 and 41 on one side of the wall 39, with a portion of the roller chain 54 which extends between the sprockets 44 and 45 positioned on the other side of the wall 39.

During movement of the chain 54 and the lift members 59 between the sprockets 44 and 45 on the outside of the wall 39, the wall 39 functions as a chain or band support to maintain movement of the chain 54 in a generally straight line path between the sprockets 44 and 45. Although the wall 39 is capable of providing this support as a result of sliding engagement between the inside surfaces of the link members 56 and 57 and the outer surface of the wall 39, the preferred embodiment of the present invention includes a chain support or slide member in the form of the chain support 69 shown best in FIGS. 5 and 6. This chain support 69 comprises a metal bar or the like having a width slightly less than the width between corresponding link members 56 and 57 and having a thickness dimension which allows the member 69 to engage the rollers 55 and prevent the links 56 from sliding engagement with the outer surface of the wall 39. In the preferred embodiment, the chain or roller support 69 extends substantially the entire distance between the band openings 66 and 68 to provide rolling engagement with the rollers 55. With this structure, the support 69 maintains the band or chain 54 in a straight line, or a desired path, between the sprockets 44 and 45.

The carriage 16, and specifically the tubular housing 38, is mounted relative to the support tower 11 to provide the desired engaging relationship between the first support surface 30 and the second support surface 65. Specifically, as the chain 54 and lift members 59 move between the sprockets 44 and 45, the second support surface 65 on the bottom of the lift member 59 is positioned to engage the first support surface 30 on top of the brace member 28 as shown. This causes the carriage 16 and thus its associated platforms 19 and 20 and platform brackets 18 and 19 to move upwardly or downwardly along the tower 11. A plurality of roller members 70 and 72 are rotatably supported relative to the tubular housing 38. These rollers 70 and 72 are designed for engagement with outer planar surfaces of the support posts 24,24 and function to provide the desired spacing and orientation between the carriage 16 and the support tower 11. Specifically, a pair of rollers 70 near the top of the housing 38 and a pair of rollers 70 near the bottom of the housing 38 are mounted in roller supports 71 which in turn are rigidly secured to the wall 39 of the housing 38. As shown, the rollers 70 engage the outer surfaces 25, 25 of the support post 24,24 in rolling engagement to maintain the wall 39 in proper spaced relationship relative to the support tower 11. Similarly, one or more rollers 72 are rotatably supported within the roller supports 74 which are rigidly connected to the side walls of the housing 38. These rollers 72 engage the outer surface 26 of the posts 24,24 to maintain the tubular housing 38 and carriage 16 in a proper side to side orientation. In an alternate embodiment it is contemplated that the rollers could be replaced by Teflon or other low friction material to reduce friction during movement of the carriage 16 up and down the support tower.

The lower end of the carriage 16 as shown in FIGS. 2 and 3 is provided with a support bracket portion 75 rigidly secured to the outer side wall 41 by welding or the like. The bracket portion 75 extends generally horizontally, is hollow, and is intended to receive material and workman platform support brackets 18 and 19 (FIG. 1) in a manner known in the art. Rigidly secured to the bracket portion 75 on the outward side of the post 31 is a support stub 76 for supporting the plank support bracket 78, the roller support brackets 79,79 and the roller support bracket 80. The roller support brackets 79, 79 and 80 are provided with rollers 81,81 and 82, respectively, for rolling engagement with the side surfaces 35,35 and the rear or outer surface 36, respectively, of the support post 31.

A plank support bracket 84 is also rigidly secured to the lower outer surface of the inner wall 40 as shown to provide a support for a platform plank. As shown, the plank supporting surfaces of the support brackets 78 and 84 are at the same level. Further, it should be noted that the adjacent ends 77 and 83 of the brackets 78 and 84 are sufficiently spaced from one another to allow the carriage assembly to pass a brace members 14 (FIG. 1) as the carriage moves up and down the support towers 11.

The upper end of the tubular carriage housing 38 is provided with a mounting arm 85 for supporting the rotation and drive assembly 86. Specifically, the mounting arm 85 is rigidly secured to the outer surface of the side wall 41 by welding or the like. Mounted at the outer end of the mounting arm 85 is a support bracket 88. The rotation and drive assembly 86 is rigidly connected with the support bracket 88 and includes a pair of side members 89,89 and a shaft 90 rotatably supported therebetween. Each end of the shaft is provided with a rotation shaft end 91,91 (FIG. 2). The ends 91,91 can be rotated either manually with a hand crank 92 or the like by any electrically driven member such as an electric drill (not shown) with a socket adapted to mate with the ends 91,91.

The rotation and drive assembly 86 further includes a pair of safety dogs mounted on the shaft 90 to prevent the carriage from accidentally dropping. Specifically, one safety dog includes the ratchet dog 96 which contacts the gear teeth on the toothed flange 98 to prevent the shaft 90 from rotating in a direction which would cause the carriage to move downwardly, unless manually disengaged. The dog 96 is gravity operated. The other safety dog comprises the speed regulating dog 94 which oscillates over the ratchet teeth on the flange 95 to positively control the rotation speed of the shaft 90. The operation of these safety features and particularly operation of the safety dogs 96 and 94 is known in the art.

The gear assembly for driving the sprockets 44 and 45 is illustrated best in FIGS. 2 and 3. In FIG. 2 the assembly is connected with the carriage 16, while in FIG. 3 the assembly is separated from the main carriage housing. One end of the drive gear assembly, namely the initial toothed drive sprocket 99 is connected with the shaft 90 for rotation by the hand crank 92 or other rotation means. The toothed sprocket 99 is in turn connected with the sprockets or gears 100, 102 and 104 by the roller chains 105, 106 and 108. As shown, the gear 100 is an idler gear provided with the smaller diameter companion gear 101 on a common hub, while the gear 102 is an idler gear provided with the smaller diameter companion gear 103 on a common hub. The gear 104 is mounted on the shaft 48 (FIGS. 2 and 3) which directly drives the lower sprocket 45. With the drive mechanism as shown, a 32:1 reduction gear ratio is achieved. It is contemplated, however, that the present invention could use other gear and drive mechanisms for rotating the members 44 and 45.

Positioned near the top of the carriage housing 38 is a spring-loaded safety latch 109 which includes a beveled top surface 110 and a flat bottom surface 111. The safety latch 109 extends through an opening 112 in the housing wall 39 and extends outwardly a sufficient distance to facilitate engagement with the support surface 30 of the brace members 28. The safety latch 109 is spring mounted and is thus biased in an outward or engagement direction. The safety latch 109 allows the carriage 16 to move upwardly relative to the support tower 11, but prevents downward movement of the carriage 16 without first manually releasing the latch 109. During upward movement, engagement between the bottom edge of the brace member 28 and the beveled top surface 110 causes the latch 109 to be moved inwardly against the spring force to release the latch 109 from engagement with the brace 28. During downward movement, however, the bottom flat surface 111 engages the first support surface 30 and prevents further downward movement unless the latch is manually released. The manual release includes a rotatable release arm 115 and a cable 114 connected to the rearward end of the latch 109. Forward rotational movement of the release arm 115 causes retraction and manual release of the latch 109.

Figures 4A, 4B, 4C, 4D:
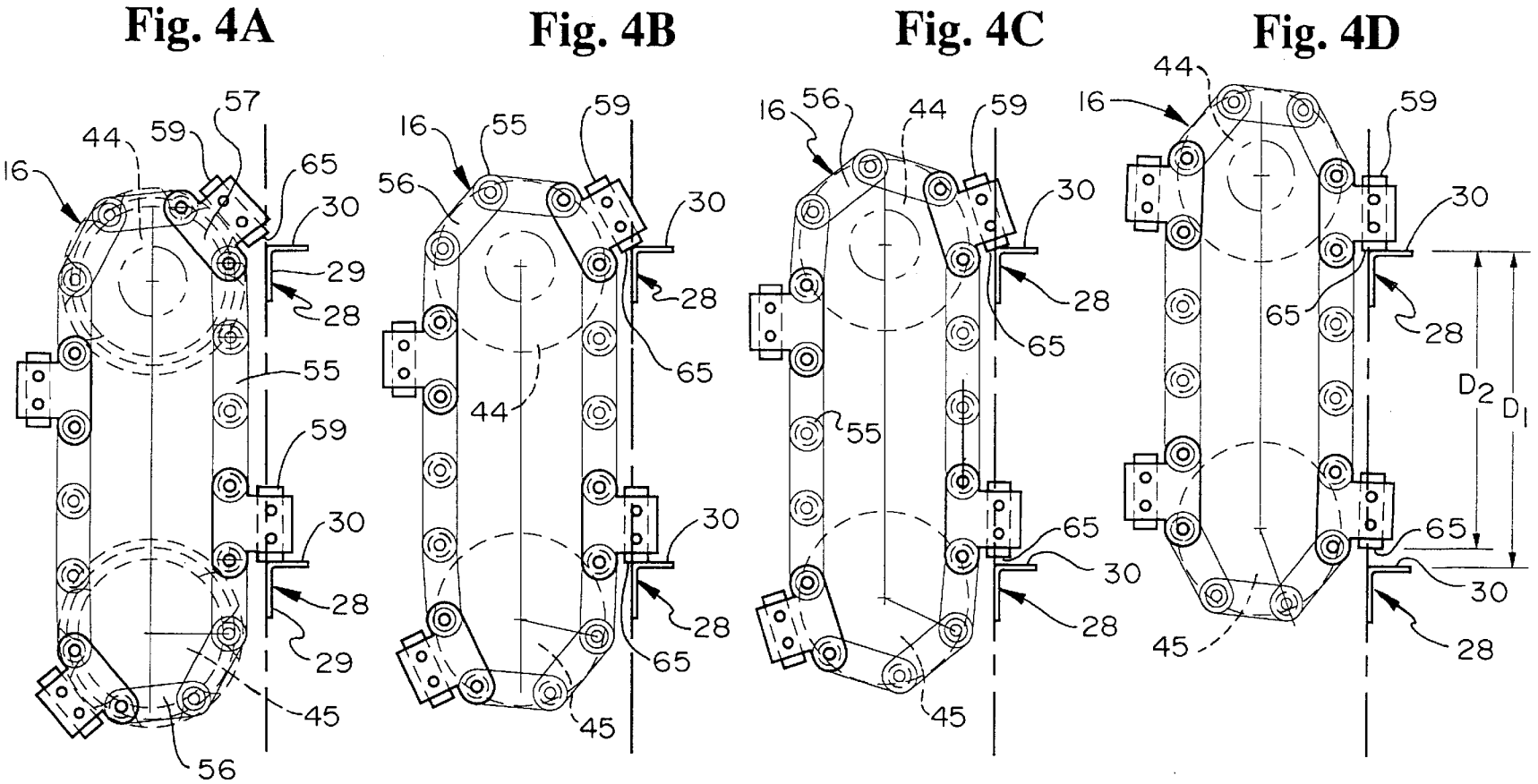
FIG. 4 is comprised of FIGS. 4A, 4B, 4C and 4D and shows sequences of operation of the lift carriage assembly in accordance with the present invention.

The operation and operational concept of the lift assembly and carriage of the present invention can be understood best with reference to FIG. 4 comprising FIGS. 4A, 4B, 4C and 4D. FIGS. 4A through 4D represent various stages of rotation of the sprockets 44 and 45 and thus various rotational positions of the lift members 56. FIGS. 4A through 4D also show the relative positions between the second support surfaces 65 of the members 59 and the first support surfaces 30 of the braces 28. In the preferred embodiment, the distance between the first support surfaces 30 of adjacent brace members 28 is greater than the distance between the second support surfaces 65,65 of adjacent lift members 59,59. As shown in FIG. 4D, the distance between adjacent first support surfaces 30 is a first distance $D_1$, while the distance between the second support surfaces 65 of adjacent lift members 59 is a second distance $D_2$. The amount of this difference in distance which is needed for proper functioning of the lift assembly of the preferred embodiment is primarily a function of several factors. These include among possible others, the size of the rotatable sprockets 44 and 45, the distance which the second support surface 65 extends outwardly from the outer periphery of the sprockets and the distance between the rotational axis of the sprockets and the first support surfaces 30. In the preferred embodiment, the rotatable sprockets 44 and 45 have a pitch diameter in the range of about 3 to 6 inches, with a preferred diameter of about 3.2 to 5.5 inches. This provides a preferred distance $D_1$ between adjacent first support surfaces 30 of about 12½ inches and a distance $D_2$ between adjacent second support surfaces 65 of about 12 inches. Thus, in the preferred embodiment, the distance between the second support surfaces 65 of adjacent lift members 59 is ½ inch shorter than adjacent first support surfaces 30.

Although the preferred embodiment shows the sprockets 44 and 45 as being of equal diameter, this is not a requirement. Further, the preferred distances of $D_1$ and $D_2$ and the difference between them can vary as long as $D_1$ is greater than $D_2$ and the other factors are such as to facilitate the functioning of the invention as described below.

With the above defined relationship, the operation of the invention is as follows. At the beginning of operation when the carriage assembly is supported independently of its respective support tower, the carriage 16 is positioned so that one of its lift members 59 is between two of the first support surfaces 30 of the brackets 28. The sprockets 44 and 45 are then rotated in a clockwise direction as shown in FIGS. 4A–4D. This causes the chain 54 and the lift members 59 to move around the sprockets and to ultimately cause a second support surface 65 of one of the lift members 59 to engage the higher of the two first support surfaces 30 as shown in FIGS. 4C or 4D. Continued rotation of the sprockets 44 and 45 then causes the second support surfaces 65 of the lift members 58 sequentially engage the first support surfaces 30 of the brackets 28 to lift or lower the carriage 16 and its associated structure. In FIG. 4A, the carriage 16 is supported entirely by the lower lift member 59.

As the sprockets 44 and 45 continue to rotate in a clockwise direction, the second support surface of the next (or upper) lift member 59 as shown in FIG. 4B begins to engage the upper first support surface 30. Thus, in FIG. 4B, the carriage 16 is supported partly by engagement between the lower first and second support surfaces 30 and 65 and partly by engagement between the upper first and second support surfaces 30 and 65.

As the sprockets 44 and 45 continue to rotate further in a clockwise direction, the second support surface 65 of the upper lift member 59 becomes fully supported by the upper first support surface 30 and the second support surface 65 of the lower lift member 59 begins to lift off and become disengaged from the lower first support surface 30. Thus, in FIG. 4C, the carriage 16 is supported solely by engagement between the second support surface 65 of the upper lift member 59 and the upper first support surface 30.

As the sprockets 44 and 45 continue to rotate further as shown in FIG. 4D, the carriage 16 continues to be fully supported by engagement between the upper second support surface 65 and the upper first support surface 30, while the lower lift member 59 and its second support surface 65 moves further away from the lower first support surface 30. Further rotation of the sprockets 44 and 45 results in the lower lift member 59 and its second support surface 65 moving entirely away from the lower support surface 30 as it travels around the lower sprocket 45 as shown in FIG. 4A. Continued rotation of the sprockets 44 and 45 causes the above process to be repeated, thereby causing the carriage 16 and its associated platforms and platform brackets to move upwardly relative to the support tower 11 and its first support surfaces 30.

When it is desired for the carriage 16 is to be lowered, the above described process is reversed. Thus, as viewed in FIGS. 4A through 4D, the sprockets 44 and 45 would rotate in a counterclockwise direction and the sequence of engagement of and disengagement from the various first and second support surfaces is from FIGS. 4D, to 4C, to 4B and to 4A.

Figure 7:
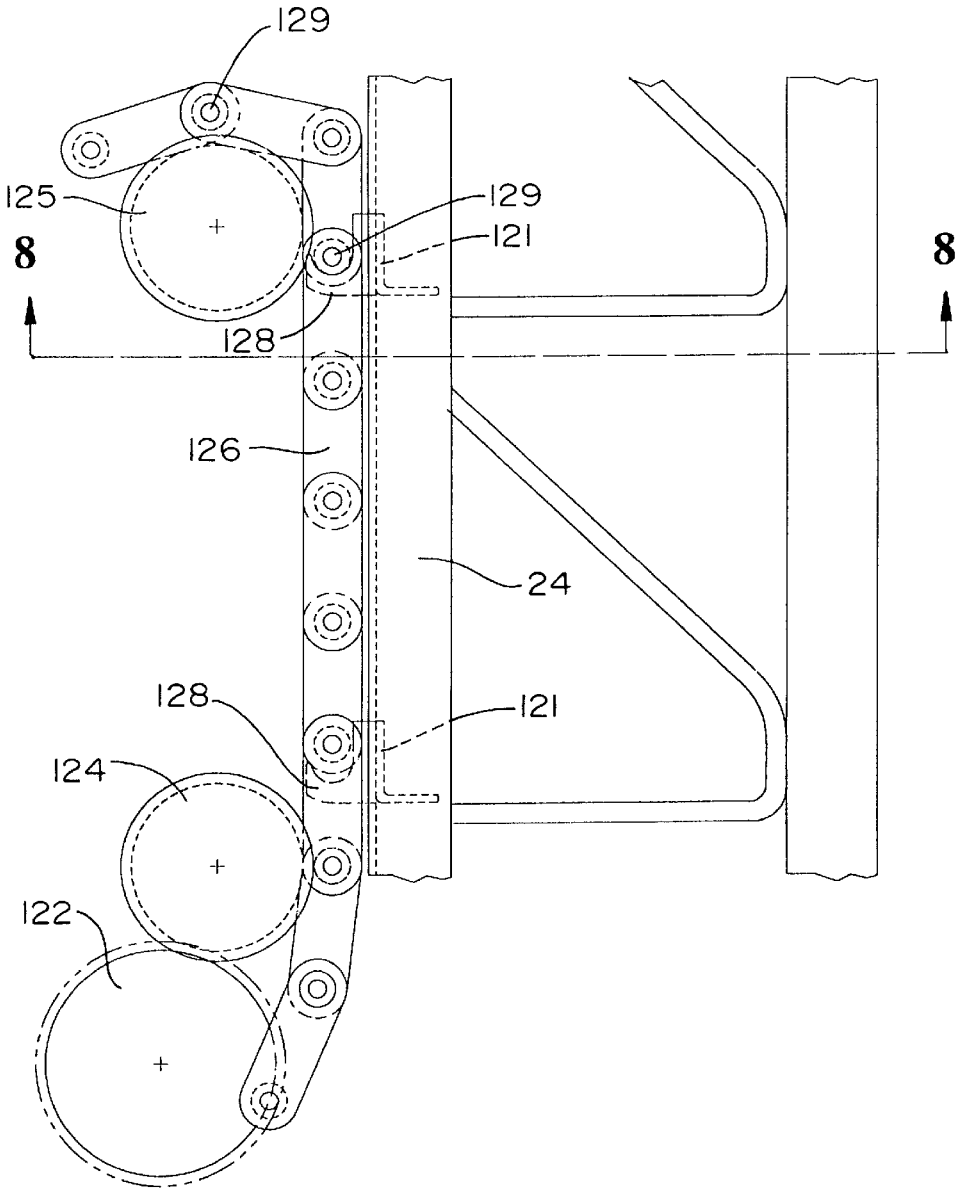
FIG. 7 is a side elevational view of a further embodiment of the support surfaces and lift members in accordance with the present invention.
Figure 8:
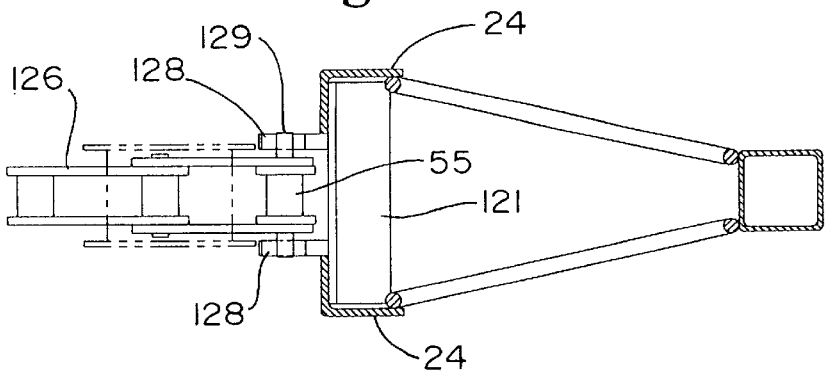
FIG. 8 is a top elevational view of the embodiment of FIG. 7.
Figure 9:
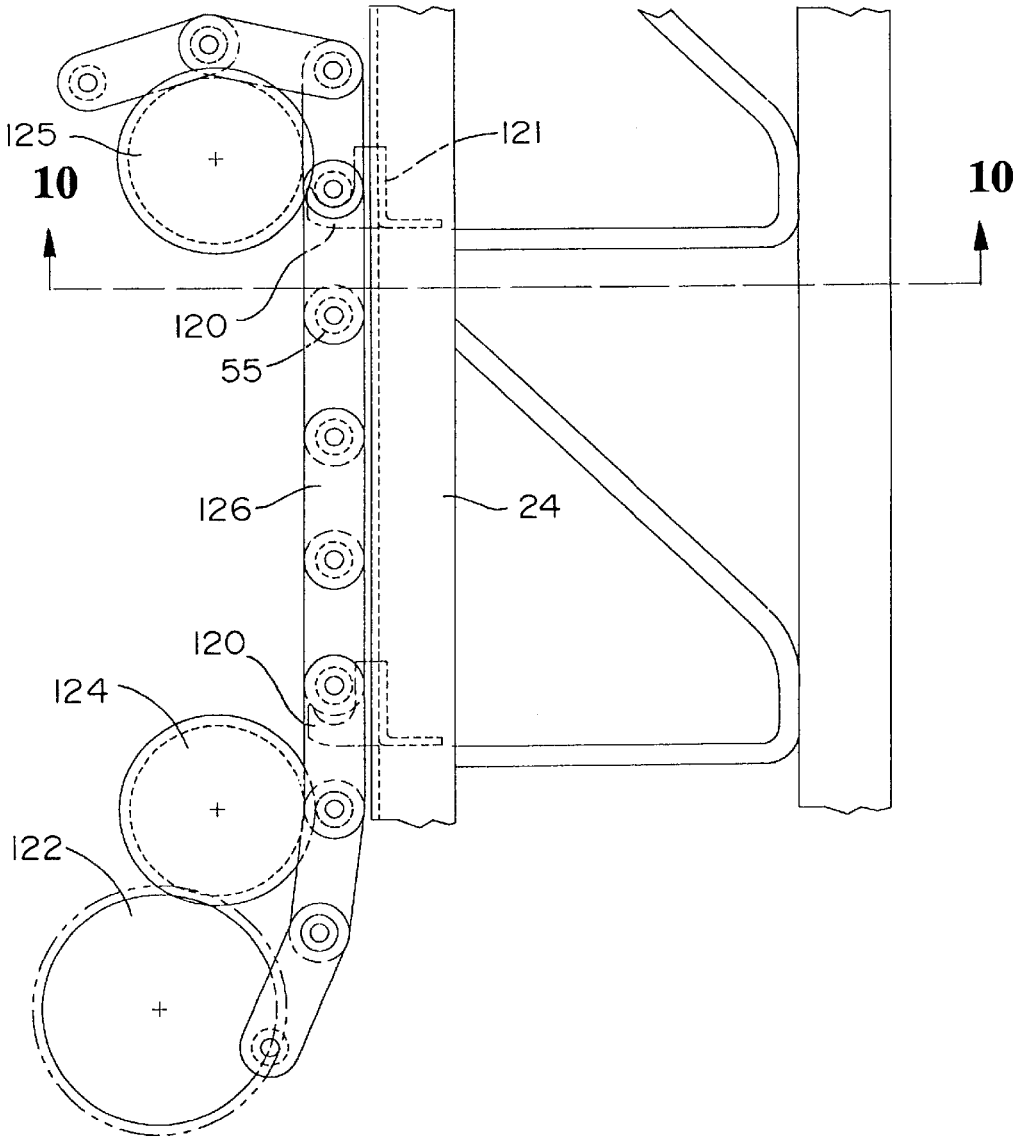
FIG. 9 is a side elevational view of a still further embodiment of the support surfaces and lift members in accordance with the present invention.
Figure 10:
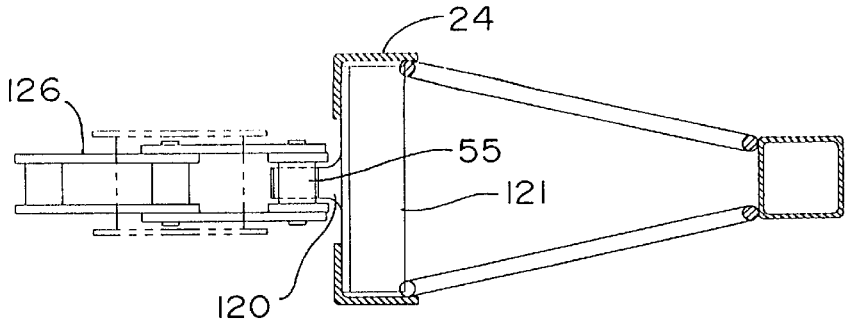
FIG. 10 is a top elevational view of the embodiment of FIG. 9.

In the preferred embodiment, various links of the chain 54 are provided with lift members 59 having a second support surface 65 extending outwardly from the chain for engagement with a first support surface 30 of the brace 28. It is also possible, however, to use hooks or lugs which are welded to and extended outwardly from the support tower 11 to engage the rollers on the climbing chain instead of using attachment links 56 in accordance with the preferred embodiment. Two alternative embodiments are illustrated in FIGS. 7 and 8 and in FIGS. 9 and 10. In the embodiment of FIGS. 7 and 8, a plurality of spaced hooks 120 are rigidly secured to longitudinally spaced brace members 121 connected between the support posts 24 of the tower 11. These hooks 120, like the first support surfaces 30 in the preferred embodiment are spaced apart a first distance. In the embodiments of FIGS. 7 and 8, the carriage is provided with a drive sprocket 122 having sprocket teeth for engagement with the roller chain 126 and a pair of non-toothed idler rollers 124 and 125 for guiding the chain 126 in the area where the lifting is accomplished. Other than this, the function of the embodiment illustrated in FIGS. 7 and 8 is essentially the same as that illustrated in FIGS. 1–6. The embodiment of FIGS. 9 and 10 is similar to that of the embodiments of FIGS. 7 and 8 except that the embodiment of FIGS. 9 and 10 includes a pair of longitudinally spaced hooks 128,128 (FIG. 10) which engage an extension of the roller pin 129.

Although the description of the preferred embodiment has been quite specific, it is contemplated that various modifications could be made without deviating from the spirit of the present invention. Accordingly, it is intended that the present invention be dictated by the appended claims rather than by the description of the preferred embodiment.

What is claimed is:

1. A support apparatus comprising:

an elongated, rigid support member having a base end, an upper end and a longitudinal axis and being supported at said base end, said support member further including first and second spaced support posts and a plurality of support braces extending between said first and second support posts along said longitudinal axis;

said support braces defining a plurality of first support surfaces spaced along said support member in the direction of said longitudinal axis;

a carriage moveable along said support member in said longitudinal direction, said carriage including;

a pair of spaced, rotatable members;

an endless band extending between and around said spaced rotatable members, and a plurality of lift members connected with said endless band, said lift members being spaced along said band and each of said lift members project outwardly of said band and have a second support surface engageable with said first support surfaces to support said carriage relative to said support member, the distance between adjacent first support surfaces in the direction of said longitudinal axis defining a first spacing and the distance between the second surfaces of adjacent lift members along said band defining a second spacing and wherein said first spacing is greater than said second spacing.

2. The support apparatus of claim 1 wherein said rotatable members are rotatable sprockets and said endless band is an endless chain.

3. The support apparatus of claim 1 wherein said rotatable members are rotatable on first and second axes generally perpendicular to said longitudinal axis and wherein said first and second axes are spaced from one another in the direction of said longitudinal axis a distance greater than said second spacing.

4. The support apparatus of claim 1 including a band support positioned between said rotatable members and in a fixed position relative to said carriage.

5. The support apparatus of claim 1 wherein said carriage includes a carriage support comprising a wall portion positioned between said rotatable members.

6. The support apparatus of claim 5 wherein said wall portion includes a band support.

7. The support apparatus of claim 6 wherein said band comprises a roller chain having a plurality of rollers and said band support is positioned for supporting engagement with said rollers during movement of said roller chain between said rotatable members.

8. The support apparatus of claim 1 wherein said rotatable members are rotatable on first and second axes generally perpendicular to said longitudinal axis and wherein said carriage includes an elongated housing support wall extending generally parallel to said longitudinal axis, said support wall having first and second sides and having a pair of band openings spaced in the direction of said longitudinal axis, said rotatable members being positioned relative to said support wall such that said first and second axes are positioned on said first side of said support wall, said band extends through said pair of band openings and a portion of said band extending between said rotatable members is positioned on said second side of said support wall.

9. The support apparatus of claim 8 wherein said carriage includes a generally tubular support housing comprising said housing support wall and a pair of housing sidewalls connected with said housing support wall and extending outwardly from said first side, said rotatable members being rotatably supported between said pair of housing sidewalls.

10. The support apparatus of claim 1 being an adjustable scaffolding assembly comprising a plurality of said support members, one of said carriages associated with each of said plurality of support members and each of said carriages including a platform support.

11. The support apparatus of claim 10 including at least one platform member extending between the platform supports of the carriages associated with an adjacent pair of said plurality of support members.

12. The support apparatus of claim 1 wherein said carriage includes a platform support.

13. The support apparatus of claim 1 wherein said first and second support posts are parallel and wherein said lift members are insertable between said first and second support posts.

14. The support apparatus of claim 13 wherein each of said lift members includes a lift member width dimension which approximates the spacing between said first and second support posts to provide minimal clearance between said lift members and said first and second support posts when said lift members are inserted between said first and second support posts.

15. The support apparatus of claim 1 wherein said support member includes a third elongated support post and said carriage includes at least one first roller engageable in rolling engagement with one of said first and second support posts during movement of said carriage along said support member and at least one second roller engageable in rolling engagement with said third support post during movement of said carriage along said support member.

16. A support apparatus comprising:

an elongated, rigid support member having a base end, an upper end and a longitudinal axis and being supported at said base end, said support member further including first and second spaced support posts and a plurality of support braces extending between said first and second support posts along said longitudinal axis;

said support braces defining a plurality of first support surfaces spaced along said support member in the direction of said longitudinal axis;

a carriage moveable along said support member in said longitudinal direction, said carriage including;

a pair of spaced, rotatable members which are rotatable on first and second axes generally perpendicular to said longitudinal axis;

an endless band extending between and around said spaced rotatable members;

a generally tubular support housing comprising is in an elongated housing support wall extending generally parallel to said longitudinal axis, said support wall having first and second sides and having a pair of band openings spaced in the direction of said longitudinal axis, said support housing further comprising a pair of housing sidewalls connected with said housing support wall and extending outwardly from said first side, said rotatable members being positioned relative to said support wall such that said first and second axes are positioned on said first of said support wall, said rotatable members are rotatably supported between said pair of housing sidewalls, said band extends through said pair of band openings and a portion of said band extending between said rotatable members is positioned on said second side of said support wall, at least one roller member supported by said tubular support housing and engageable in rolling engagement with said support member during movement of said carriage along said support member, and a plurality of lift members connected with endless band, said lift members being spaced along said band and each of said lift members having a second support surface engageable with said first support surfaces to support said carriage relative to said support member.

17. An adjustable scaffolding assembly comprising:

a plurality of elongated, rigid support members having a bottom end, a top end and a longitudinal axis, and being supported near said bottom end;

a plurality of first support surfaces spaced along said support members in the direction of said longitudinal axis;

a carriage associated with and moveable along each of said support members in said longitudinal direction, each said carriage including:

a pair of spaced, rotatable members;

an endless band extending between and around said spaced rotatable members;

a plurality of lift members connected with said endless band, said lift members being spaced along said band and each of said lift members project outwardly of said band and have a second support surface engageable with said first support surfaces to support said carriage relative to said support member, the distance between adjacent first support surfaces in the direction of said longitudinal axis defining a first spacing and the distance between the second surfaces of adjacent lift members along said band defining a second spacing and wherein said first spacing is greater than said second spacing and a platform support.

18. The adjustable scaffolding of claim 17 including at least one platform member extending between the platform supports of the carriages associated with adjacent support members.

19. A lift assembly comprising:

an elongated, rigid support member having a longitudinal axis;

a plurality of first support surfaces spaced along said support member in the direction of said longitudinal axis;

a carriage moveable along said support member in said longitudinal direction; said carriage including:

a pair of spaced, rotatable members;

an endless band extending between and around said spaced rotatable members, and a plurality of lift members connected with said endless band, said lift members being spaced along said band and each of said lift members project outwardly from said band and have a second support surface engageable with said first support surfaces to support said carriage relative to said support member, wherein the distance between adjacent first support surfaces in the direction of said longitudinal axis is a first spacing and the distance between the second support surfaces of adjacent lift members along said band is a second spacing and wherein said first spacing is greater than said second spacing.

* * * * *